United States Patent [19]

Savage

[11] Patent Number: 4,800,147

[45] Date of Patent: Jan. 24, 1989

[54] XEROGRAPHIC PROCESS WITHOUT CONVENTIONAL CLEANER

[75] Inventor: Edward C. Savage, Webster, N.Y.

[73] Assignee: Xerox Corporation, Stamford, Conn.

[21] Appl. No.: 81,080

[22] Filed: Aug. 3, 1987

[51] Int. Cl.[4] ..... G03G 21/00; G03G 15/06; G03G 15/00; G03G 13/00

[52] U.S. Cl. ..... 430/125; 118/652; 355/300; 355/15; 430/54

[58] Field of Search ..... 355/3 DD, 15; 118/652, 118/657, 658; 430/125, 54, 122, 126

[56] References Cited

U.S. PATENT DOCUMENTS

| | | | |
|---|---|---|---|
| 3,615,398 | 10/1971 | Caldwell | 430/125 |
| 3,640,707 | 2/1972 | Caldwell | 430/125 X |
| 3,649,262 | 3/1972 | Cade et al. | 96/1.4 |
| 4,265,998 | 5/1981 | Barkley | 118/652 X |
| 4,470,693 | 9/1984 | Dolan | 355/15 |

FOREIGN PATENT DOCUMENTS

| | | | |
|---|---|---|---|
| 202474 | 11/1983 | Japan | 355/15 |
| 195864 | 11/1983 | Japan | 355/15 |

OTHER PUBLICATIONS

Xerox Disclosure Journal, vol. 7, No. 3, May/Jun. 1982, p. 211, "Developer/Cleaner for Magnetic Toner with Enhanced Performance".

*Primary Examiner*—A. C. Prescott

*Assistant Examiner*—Ed Pipala

*Attorney, Agent, or Firm*—Ronald F. Chapuran

[57] ABSTRACT

The invention is an electrophotographic imaging process comprising forming a first electrostatic latent image on an imaging surface of an electrophotographic imaging member comprising an electrophotographic insulating layer and an electrically conductive layer, developing said first electrostatic latent image with a conductive two-component developer having a conductivity between about $10^{-10}$ ohms-cm$^{-1}$ and about $10^{-14}$ ohms-cm$^{-1}$ in a development zone between said imaging surface and an electrically conductive developer applicator to form a toner image corresponding to said first electrostatic latent image, transferring most of said toner image to a receiving member with a residual toner image remaining on said imaging surface forming a second electrostatic latent image on said imaging surface bearing said residual toner image, and simultaneously developing said second electrostatic latent image and removing said residual toner image by contacting said electrophotographic imaging surface in said development zone with conductive two-component developer while simultaneously maintaining the minimum distance between said electrically conductive layer and said electrically conductive developer applicator in said development zone, supplying an electrical bias to said electrically conductive layer, and supplying an electrical bias to said conductive developer applicator.

1 Claim, 5 Drawing Sheets

XEROGRAPHIC PROCESS WITHOUT CONVENTIONAL CLEANER

BACKGROUND OF THE INVENTION

This invention relates to electrostatic imaging and more specifically to the simultaneous development of electrostatic latent images and the removal of the residual toner images from a support surface Generally, the xerographic process is performed upon a xerographic plate comprising a layer of photoconductive insulating material upon a conductive backing. The surface of the plate is uniformly charged and then exposed to a light and shadow image pattern. The photoconductive plate discharges in the exposed areas proportionally to the intensity of the radiation reaching the exposed area, thereby creating an electrostatic latent image on the surface of the photoconductive layer corresponding to the light and shadow image pattern projected upon the plate. The electrostatic latent image is then developed by contact with an electroscopic marking material called "toner." The electrostatic latent image which has been developed by contact with toner is then referred to as the "toner image" or "developed image." This developed image may be fixed on the xerographic plate itself, or it may be transferred to paper or other material, and the transferred image may be fixed on said other material. However, after the developed image is transferred to another base material, there may still be and there typically is, a residual image of toner particles adhering to the surface of the photoconductive layer. If this residual image is not removed before the plate is resused, portions of the residual image may be transferred and fixed to any new copy which is made from the same plate.

To control and prohibit subsequent transfer of the residual images in such automatic apparatus, it has been found to be commercially expedient to develop and clean in sequence and at separate locations around a rotating drum or on a xerographic plate and to neutralize the residual charge on the plate and on the residual toner after the toner image is transferred and before the plate is cleaned and recycled. Neutralizing a xerographic plate after transfer with an oppositely charging corona or lamp allows the residual toner particles to be more readily brushed off the surface by any suitable means such as a rotating brush or stationary blade. Once the surface of the xerographic plate is cleaned, the entire xerographic cycle may be started again on the same plate.

Prior art cleaning methods include a brush with bristles which are soft and of suitable triboelectric characteristics, and yet sufficiently firm to remove residual toner particles from the xerographic plate. Also, used are webs or belts of soft fibrous materials or tacky materials, and pliable cleaning blocks with a beveled edge or blades that contact the photoreceptor surface.

In spite of the successes that have been achieved in cleaning the prior art solutions to the problems in the development and cleaning steps in the xerographic process are not entirely satisfactory. For example, cleaning still typically requires bulky apparatus and a separate and distinct cleaning station. Experience has shown that the greater the number of appartus stations necessary to carry out the xerographic process, the greater the danger of toner powder escaping throughout the mechanism and dusting the operating apparatus. Also, typically development and cleaning must be performed at different areas of the xerographic plate, which requires more apparatus to ensure that that portion of the xerographic plate being used to reproduce the desired image is correctly registered at each of the xerographic stations. Experience in the art of photoconductors has shown that the greater the number of passes necessary to clean or develop the surface of said photoconductor, the fewer the number of cycles through which said photoconductor or xerographic plate can be used with acceptable image quality. The surface of the photoconductor is partially abraded by multiple passes through development or cleaning steps, and scratches in the surface of the plate may mechanically pick up toner particles thereby darkening the background areas of desired images. In addition, increased numbers of passes through development or cleaning stations tend to increase toner consumption and to impair toner concentration in the developer system. Each of these effects contributes to reduced image quality in the prior art system.

It should be noted that a cleaning failure, failure of the cleaning station to remove untransferred toner from a previous copy, can result in positive image ghosting on the next copy. Also, a more catastrophic failure can occur if uncleaned toner migrates under the charge corotron, is charged to a high potential, and begins to pull developer bead out of the developer housing.

U.S. Pat. No. 3,649,262, assigned to the same assignee as the present invention, discloses a system for removing residual toner images from electrostatographic image support surfaces and simultaneously developing an undeveloped electrostatic latent image on essentially the same area of the surface by cascading developer along the image support surface of the plate. A difficulty with U.S. Pat. No. 3,649,262 is that high density images are not cleaned and too low of density images are difficult to reproduce. For example, FIG. 3 in U.S. Pat No. 3,649,262 illustrates an operating window or range of operation as function of the of charging voltage and relative exposure illumination. In particular, because of cascade development, the degree of developed image density is limited.

It would be desirable therefore, to provide a simultaneous cleaning and developing system that overcomes much of the prior art difficulties. It is an object, therefore, of the present invention to provide a new and improved simultaneous development and cleaning system. It is still another object of the present invention to provide a conductive twocomponent developer that simultaneously cleans toner from the photoreceptor surface and develops a relatively high or low density image. Further advantages of the present invention will become apparent as the following description proceeds and the features characterizing the invention will be pointed out with particularly in the claims annexed to and forming a part of this specification.

DESCRIPTION OF THE INVENTION

Briefly the present invention is an electrophotographic imaging process comprising forming a first electrostatic latent image on an imaging surface of an electrophotographic imaging member comprising an electrophotographic insulating layer and an electrically conductive layer, developing said first electrostatic latent image with a conductive two-component developer having a conductivity between about $10^{'10}$ ohms-$cm^{-1}$ and about $10^{-14}$ ohms-$cm^{-1}$ in a development zone between said imaging surface and an electrically conductive developer applicator to form a toner image corresponding to said first electrostatic latent image, transferring most of said toner image to a receiving member with a residual toner image remaining on said imaging surface, erasing said first electrostatic latent image, forming a second electrostatic latent image on said imaging surface bearing said residual toner image, and simultaneously developing said second electrostatic latent image and removing said residual toner image by contacting said electrophotographic imaging surface in said development zone with conductive two-component developer while simultaneously maintaining the minimum distance between said electrically conductive layer and said electrically conductive developer applicator in said development zone between about 0.025 inches and about 0.065 inches, supplying an electrical bias to said electrically conductive layer of between about 350 volts and about 850 volts, and a supplying an electrical bias to said conductive developer applicator of between about 30 volts and about 350 volts.

For a better understanding of the present invention, reference may be had to the accompanying drawings, wherein the same reference numerals have been applied to like parts and wherein.

Figure 3A:
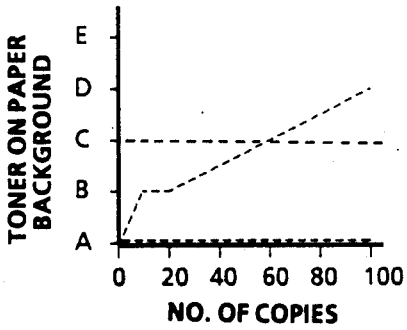
Figure 3B:
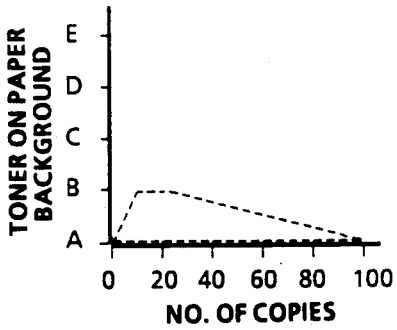
Figure 3C:
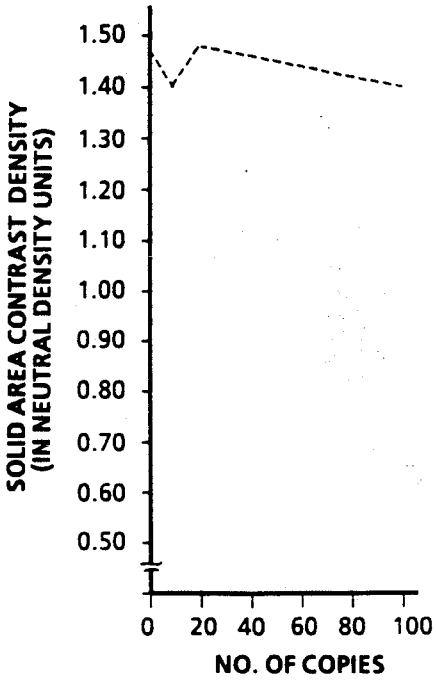
Figure 3D:
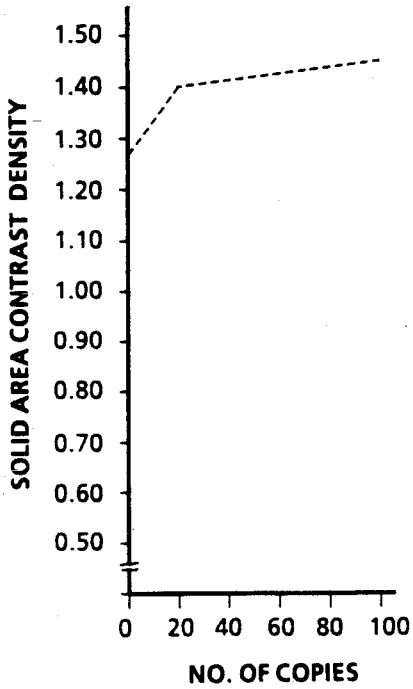
Figure 3E:
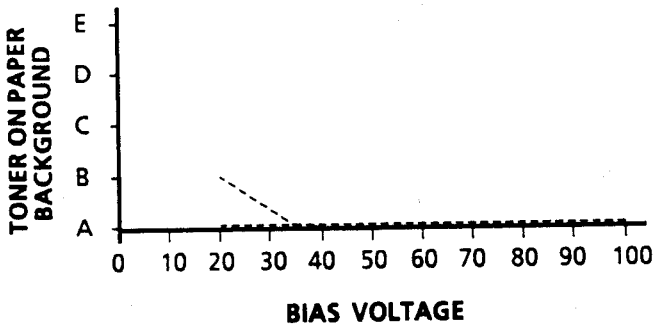
Figure 3F:
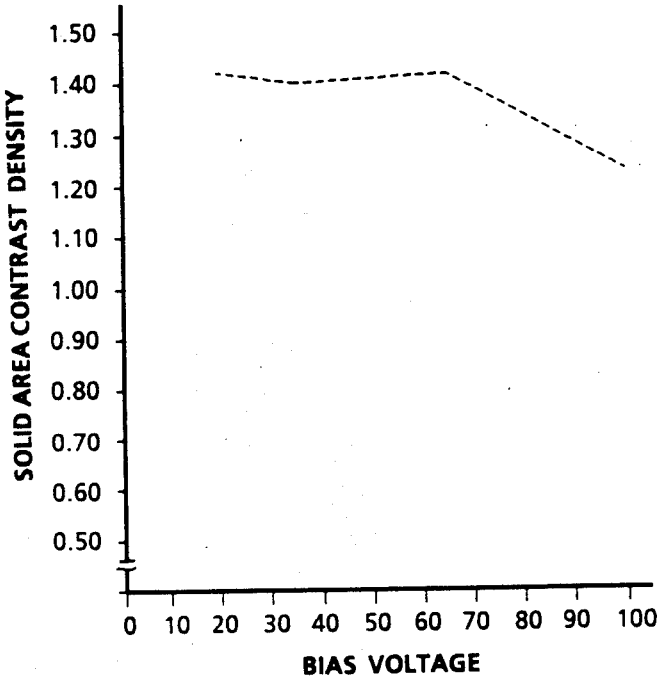
Figure 4:
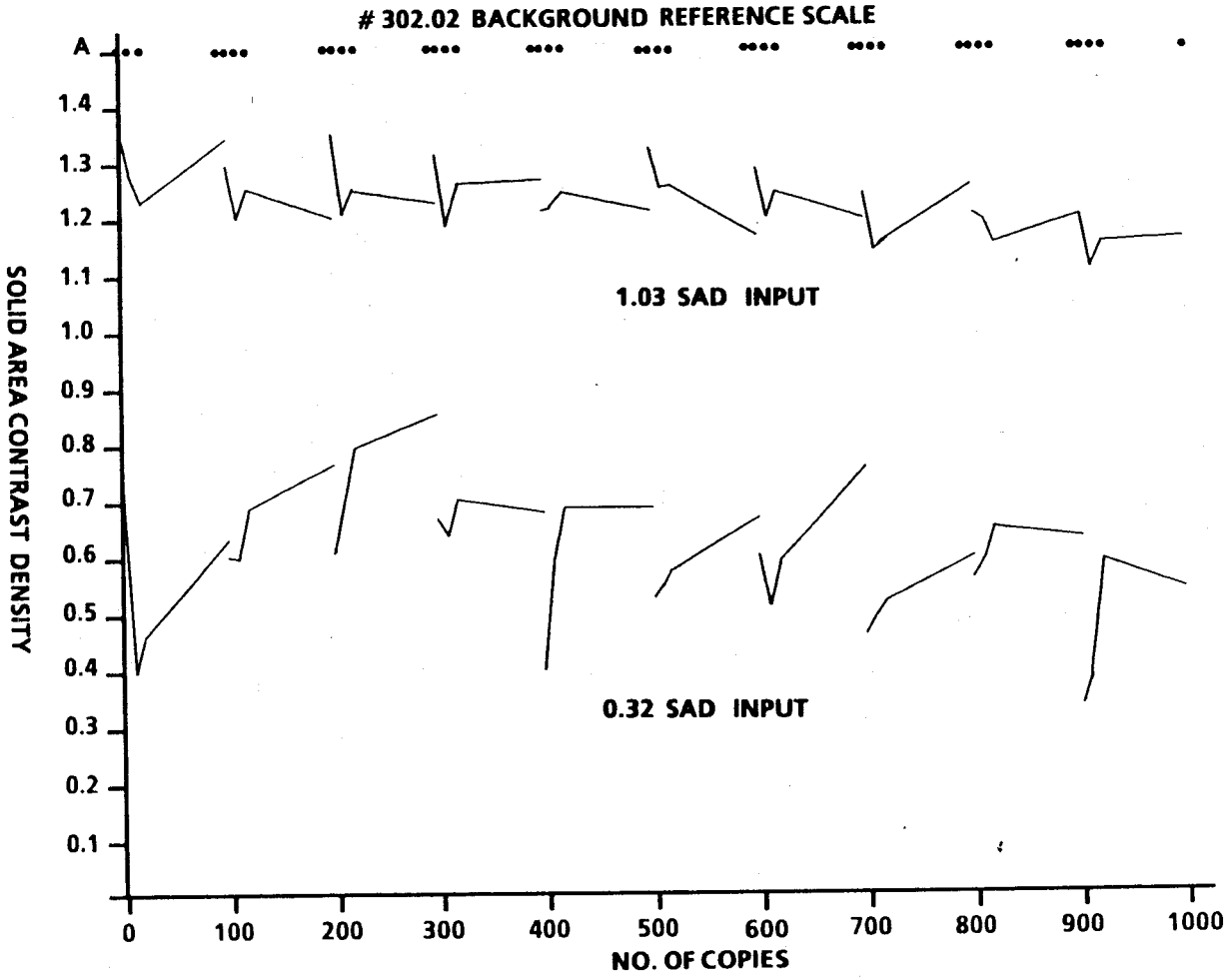

FIG. 3*a* through 3*f* are graphs showing the effect of bias voltage on copy background and the effect of using an AC preclean corotron; and FIG. 4 is a graph illustrating results in a machine with the AC preclean corotron and the entire cleaning assembly removed.

Figure 1:
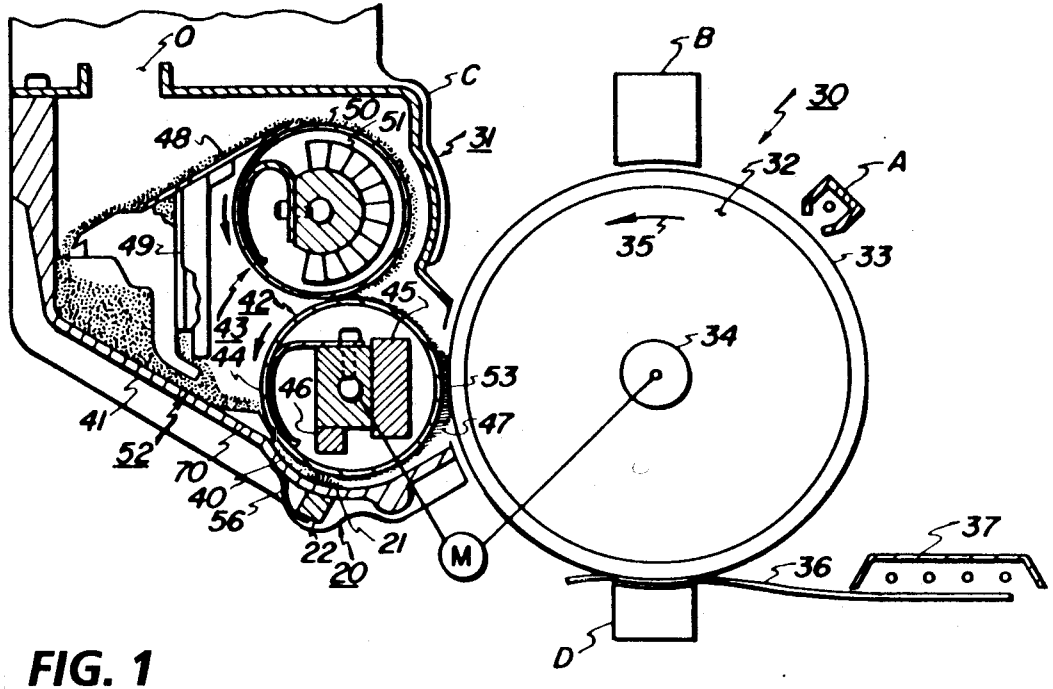
FIG. 1 is a representation of a reproducing apparatus incorporating the present invention.
Figure 2:
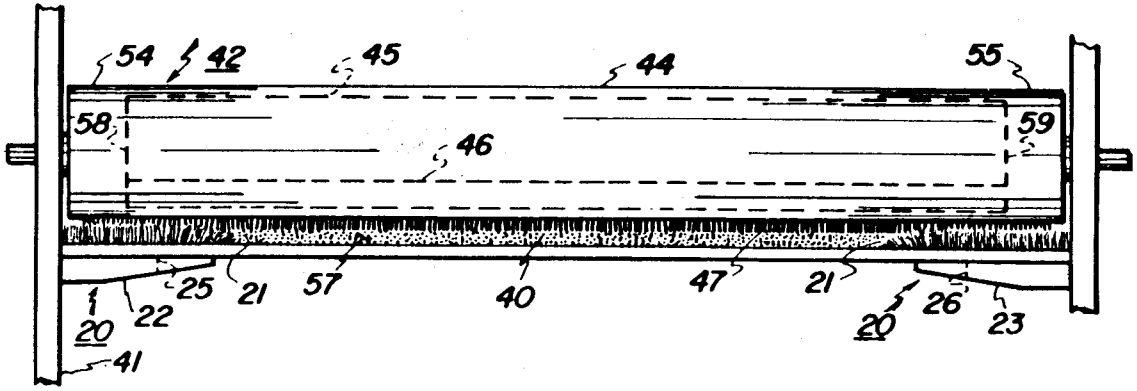
FIG. 2 is a partial front view in partial cross-section in FIG. 1.

The reproducing machine 30 illustrated in FIG. 1 employs an image recording drum-like member 32, the outer periphery of which is coated with a suitable photoconductive material 33. The drum 32 is suitable journaled for rotation within a machine frame (not shown) by means of shaft 34 and rotates in the direction indicated by arrow 35 to bring the image-bearing surface 33 thereon past a plurality of xerograhic processing stations. Suitable drive means M are provided to power and coordinate the motion of the various cooperating machine components whereby a faithful reproduction of the original input scene information is recorded upon a sheet of final support material 36 such as paper or the like.

The various processing stations for producing a copy of an original are herein represented as blocks A to D. Initially, the drum 32 moves the photoconductive surface 33 through a charging station A. In the charging station A, an electrostatic charge is place uniformly over the photoconductive surface 33 preparatory to imaging.

Thereafter, the drum 32 is rotated to exposure station B wherein the charged photoconductive surface 33 is exposed to a light image of the original input scene information whereby the charge is selectively dissipated in the light exposed regions to record the original input scene in the form of a latent electrostatic image. After exposure drum 32 rotates the electrostatic latent image recorded on the photoconductive surface 33 to development station C in accordance with the invention wherein a conventional developer mix is applied to the photoconductive surface 33 of the drum 32 rendering the latent image visible. A suitable development station is disclosed in U.S. Pat. No. 3,707,947, describing a magnetic brush development system utilizing a magnetizable developer mix having ferro-magnetic carrier granules and a toner colorant. The developer mix is brought through a directional flux field to form a brush thereof, the electrostatic latent image recorded on the photoconductive surface 33 is developed by bringing the brush of developer mix into contact therewith.

The developed image on the photoconductive surface 33 is then brought into contact with the sheet 36 of final support material within a transfer station D and the toner image is tranferred from the photoconductive surface 33 to the contacting side of the final support sheet 36. The final support material may be paper, plastic, etc., as desired.

After the toner image has been transferred to the sheet of final support material 36 the sheet with the image thereon is advanced to a suitable fuser 37 which coalesces or fuses the transferred powder image thereto. After the fusing process the sheet 36 is advanced to a suitable output device.

Although a preponderance of the toner powder is transferred to the final support material 36, invariably some residual toner remains on the photoconductive surface 33 after the transfer of the toner powder image to the final support material. Sufficient residual toner particles remaining on the photoconductive surface 33 after the transfer operation are removed from the drum 32 by the conductive mag brush in accordance with the present invention.

Referring again to the development apparatus 31 it includes a storage portion or sump 40 in a housing 41 for storing the developer material. The system could include toner dispenser (not shown) disposed over the opening which periodically dispenses toner in the housing. Alternatively, the circulating system could be the type where toner and/or toner plus carrier is added periodically by an operator or an attendant to the machine.

The development apparatus 31 includes magnetic brush rolls 42 and 43. The magnetic brush applicator roll 42 includes a rotatably mounted support member in the form of a cylindrical shell or sleeve 44 and a stationary permanent magnet 45 suspended within the sleeve. The magnetic field of the magnet is oriented to form a brush-like structure of the developer mix. The applicator roll 42 is immersed in the sump 40 of developer material which comprises ferro-magnetic carrier particles and a toner colorant. The developer mix is picked up by the outer support surface of the of the roll 42 by means of a pick-up magnetic field generated by stationary magnet 46 suspended within the sleeve 44, and is formed into a brush-like structure for application on to the photoconductive surface 33 for development of the latent electrostatic image presented thereon. While only one applicator roll 42 is shown, any number of applicator rolls could be employed as desired.

Continued rotation of the roll past the development zone brings the magnetic brush 47 into the field of a lifting magnetic brush roll 43. The lifting roll 43 attracts the developer mix from the magnetic brush applicator roll 42 and carries it upward to be deposited on a slide 48 from which it flows into a cross-mixer 49 for return to the sump 40. The lifting roll 43 is also a magnetic brush roll and comprises a cylindrical sleeve 50 rotatably supported in the housing 41 and a fixed permanent magnet 51 supported in a stationary positioned within the sleeve.

In accordance with the present invention, a conventional xerographic system can be operated without the cleaning subsystem and yet maintain clean multiple copies without image ghosting and without catastrophic failure. Specifically, the cleaning subsystem can be eliminated by using a conductive two-component developer system, the use of light and/or AC corotron erase, and the correct specifications for photoreceptor drum to magnetic roll spacing, photoreceptor potential and developer bias voltage. A correct combination of these variables provides the means by which residual toner on the photoreceptor is scavenged and latent images are developed during single pass through the development zone.

It should be noted that the development potential on the photoreceptor surface is the charge maintained on the photoreceptor after charging and exposure. The exposure is the light reflected from an opaque target or object. Generally, a suitable controller is electrically connected to a high voltage power supply through suitable interface logic to control the wire voltage of a charging corotron to maintain a constant dark development potential. The background potential (BBG) is the charge on the photoreceptor after exposure with light reflected from a white target or object. A bias control is also often electrically connected to the rotatable tubular member of a developer roll to vary the electric field between the developer roll and the photoreceptor. It should also be noted that there is a class of organic materials used in photoreceptors surfaces referred to as broad organic spectrum (BOS) materials used in the preferred embodiment. In addition, inorganic photoreceptors have also been used, such as selenium alloys and amorphous silicon. The following are exemplary of the conditions for set points to eliminate the use of a separate cleaner in a xerographic machine.

EXAMPLE I

VDDP (Dark Potential Voltage) =400 volts
VBG (Background Voltage) =50 volts
DRS (Drum to Developer Roll Spacing) =0.045"

The carrier-Quebec Metals (CQM) 69 cores sieved to 65 micron particle size. The carrier includes oxidized 0.7 percent methyl methacrylate coating. There is a 125 volt breakdown potential of the core with a toner concentration of 1 percent, and conductivity equal $3\times10^{-10}$ (ohms-cm)$^{-1}$.

The toner is a carbon black loaded polymer with external additions of zinc stearate and aerosil. The bias on the developer roll is floating.

The floating bias on the developer roll means that the developer roll was insulated with respect to ground and no potential applied to roll. Thus, the developer assumes the average charge that is seen on the photoreceptor. The normal cleaning system was displaced but the AC pretransfer corotron was left in place.

The developer used in EXAMPLE I had been aged to over 30,000 copies in a previous life test and still worked well in a cleanerless mode. The percent toner concentration could be run high to get 1.35 solid area density without a cleaning related failure. Also simulating a copy jam such that untransferred toner remained on the surface did not produce a cleaning failure on succeeding copies after the jam was cleared.

EXAMPLE II

VDDP=350 volts
VBG=10 volts
DRS=0.045"

The Carrier-Quebec Metals (CQM) is the same as EXAMPLE I. The toner is the same toner as EXAMPLE I except the toner contained polyproplene wax. The Developer Roll Voltage Bias equals 65 volts.

With respect to EXAMPLE II, FIG. 3*a* shows the copy background (or toner on the background) as a function of the number of copies at 65 volts bias and 10 volts VBG without the AC preclean corotron. C level or greater, i.e. the levels D and E are considered unacceptable toner background on copiers. The vertical axis represents a visual measure of the toner on paper background. The X axis represents the number of images or copies out. FIG. 3*b* illustrates the toner on the background as a function of the number of copies with an AC preclean corotron. FIG. 3*c* illustrates the solid area as a function of the number of copies without an AC preclean corotron and FIG. 3*d* illustrates the solid areas density-contrast density as a function of the number of copies with an AC preclean corotron. As illustrated in FIG. 3e and 3f for EXAMPLE I, there is shown both the copy background and solid area density as a function of the bias voltage on the development roller. For EXAMPLE II, it should be noted that the toner concentration could run quite high to get a 1.42 solid area density without a cleaning related failure. Also, the entire cleaning assembly, including cleaning blade, seal roll and auger could be removed without a cleaning failure. As illustrated, the AC preclean corotron helps keep the copy background low, with VBC=50 in EXAMPLE I and VBG =10 in EXAMPLE II.

EXAMPLE III

VDDP=350 volts
VBG=0 volts
DRS=0.045 inches
Carrier=Same as EXAMPLE I and II
Toner - Same as EXAMPLE I
Bias Voltage=30

In EXAMPLE III, there was no AC preclean corotron erase and VBG was reduced to zero. With respect to EXAMPLE III, FIG. 4 illustrates copy background and solid area density output from 1.0 and 0.3 density inputs as a function of the number of copies. The graphs illustrate a high solid area density output with clean background over 1,000 copies. In this example, the entire cleaning assembly and the AC preclean corotron were removed. No toner dispensing was used during the test and is reflected by the gradual fall off of image density. Copy background remained very low through the test and only very slight ghosting was observed in the low density solids. Ghosting could be observed on sequential copies because the copy image was asychronous to the photoreceptor, advancing slightly with each copy. Additional testing showed that output density could be increased up to 1.46 from a 1.0 input without any cleaning related failures. The A graph in FIG. 4 illustrates the A level of toner on paper background in FIGS. 3*a*, 3*b*, and 3*e*. It is the standard Xerox toner background reference for black toner. The 1.03 SAD input graph represents, the solid area density of a first input batch and the 0.32 SAD input graph represents the solid area of a second input patch.

The results from EXAMPLES I, II and III suggest improved cleaning operation with a reduced (from which might be considered standard potentials for the photoreceptor device used) dark potential voltage, increased exposure, increasing the developer conductivity, and the use of the AC preclean corotron.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A non-synchronous electrophotographic imaging process comprising forming a first electrostatic latent image on an imaging surface of a photoconductive layer, developing said first electrostatic latent image with a conductive two-component developer having a conductivity between about $10^{-10}$ ohms-cm$^{-1}$ and about $10^{-14}$ ohms-cm$^{-1}$ in a development zone between said imaging surface and an electrically conductive developer applicator to form a toner image corresponding to said first electrostatic latent image, transferring most of said toner image to a receiving member with a residual toner image remaining on said imaging surface, forming a second electrostatic latent image on said imaging surface bearing said residual toner image, and simultaneously developing said second electrostatic latent image and removing said residual toner image by contacting said imaging surface in said development zone with conductive two-component developer while simultaneously maintaining the minimum distance between the photoconductive layer and said electrically conductive developer applicator in said development zone between about 0.025 inches and about 0.065 inches, charging said photoconductive layer between 350 volts and 450 volts, and supplying an electrical bias to said conductive developer applicator between 30 volts and 350 volts.

* * * * *